United States Patent [19]

Perrin

[11] 3,982,368

[45] Sept. 28, 1976

[54] WALL CONSTRUCTION AND METHOD TO MAKE SAME

[75] Inventor: Arthur Perrin, Miami, Fla.

[73] Assignee: American Volkscastle International Inc., Fort Lauderdale, Fla.

[22] Filed: Dec. 18, 1974

[21] Appl. No.: 534,014

Related U.S. Application Data

[63] Continuation of Ser. No. 397,455, Sept. 14, 1973, which is a continuation of Ser. No. 173,136, Aug. 19, 1971, which is a continuation-in-part of Ser. No. 16,125, March 3, 1970.

[52] U.S. Cl. ..... 52/381; 52/405

[51] Int. Cl.[2] ..... E04B 1/16

[58] Field of Search ..... 52/380–383, 52/405, 576, 577

[56] References Cited

UNITED STATES PATENTS

| | | | |
|---|---|---|---|
| 1,694,542 | 12/1928 | Hedden | 52/381 |
| 1,875,131 | 8/1932 | Pentland | 52/383 |
| 2,050,609 | 8/1936 | Howell | 52/380 |
| 2,187,959 | 1/1940 | Williams | 52/381 |
| 2,262,899 | 11/1941 | Melhlin | 52/405 |
| 2,309,147 | 1/1943 | Wilkinson | 52/383 |
| 2,477,381 | 7/1949 | Lewis | 52/405 |
| 2,718,138 | 9/1955 | Jones | 52/381 |
| 3,559,355 | 2/1971 | Day | 52/383 |

FOREIGN PATENTS OR APPLICATIONS

| | | | |
|---|---|---|---|
| 107,186 | 9/1927 | Austria | 52/405 |
| 1,066,005 | 9/1954 | Germany | 52/577 |

OTHER PUBLICATIONS

Eng. News–Record–Apr. 21, 1960–p. 76.

*Primary Examiner*—Ernest R. Purser
*Assistant Examiner*—William Randolph
*Attorney, Agent, or Firm*—Beveridge, DeGrandi, Kline & Lunsford

[57] ABSTRACT

A wall, such as a load bearing wall, and method for forming same. The wall comprises a core member having a substantial void therein and reticulated sheets of reinforcing material positioned on both sides of the core and spaced therefrom. The wall is formed as by spraying cementitious material through and around the sheet material thus to produce a composite wall comprising first and second panels of reinforced cementitious material in spaced relation, having a hollow core therebetween, said panels being joined together as a unitary structural member.

8 Claims, 12 Drawing Figures

INVENTOR.
ARTHUR PERRIN

BY
Lilling and Siegel
ATTORNEYS

INVENTOR.
ARTHUR PERRIN

BY

Lilling and Siegel
ATTORNEYS

INVENTOR.
ARTHUR PERRIN

BY
Lilling and Siegel
ATTORNEYS

INVENTOR.
ARTHUR PERRIN

BY

Lilling and Siegel
ATTORNEYS

INVENTOR.
ARTHUR PERRIN

BY
Lilling and Siegel
ATTORNEYS

WALL CONSTRUCTION AND METHOD TO MAKE SAME

RELATED APPLICATIONS

This is a continuation of application Ser. No. 397,455, filed Sept. 14, 1973, which application is a Continuation of application Ser. No. 173,136, filed Aug. 19, 1971, which in turn is a Continuation-in-Part of application Ser. No. 16,125, filed Mar. 3, 1970, which applications are relied upon and the entire disclosures and specifications of which are hereby incorporated by reference.

BACKGROUND OF THE INVENTION

This invention relates generally to pre-fabricated building constructions, and more particularly to pre-fabricated panel units which may be joined to form walls or the like.

Home construction as is prevalent in the southern states of the United States and other tropical and semi-tropical areas throughout the world comprises substantially the building of outside or bearing walls of concrete or cement block. Such a wall construction is inadequate as a moisture or thermal barrier. Consequently, it is necessary to affix to the outer surface of the wall a layer of stucco, cement or other material which may or may not constitute a barrier.

The interior wall, however, is finished in the following manner: It may first be coated with an insulation or tar paper material and then furring strips are secured thereover. Wallboard or wire lathe may then be affixed over the furring strips. If wallboard is used, the wall may be then deemed to be finished except for taping of joints. If wire lathe or plaster board is used over the furring strips, then the wall must be plastered with a minimum of two coats of plaster in order to obtain the desired finish. As is readily apparent, the significant labor involved in such operations is extensive and costly and, not infrequently, is of poor quality.

To facilitate the construction of housing units and minimize labor, there are known various types of pre-fabricated units, and particularly panel units. In general, the primary requirements of such pre-fabricated units are that these units be strong, light-weight, constructed of inexpensive material, and capable of being assembled with a minimum of time and effort.

Obviously, however, normally certain sacrifices and compromises have been necessary in achieving the above-mentioned requirements in known pre-fabricated constructions. For example, high-quality reinforcing and structural members which are both light-weight and strong, e.g., including aluminum or magnesium in their construction, have tended to be comparatively expensive and have not been entirely successful in achieving the goal of ease of assembly. Conversely, where it has been desired to compromise by combining strength with low cost, as with cementitious materials, the resulting structures have been subject to increased weight, thus tending to make assembly thereof correspondingly more involved.

An object of this invention is to provide an improved panel unit to form a bearing wall which eliminates the above disadvantages.

Another object of the present invention is to provide a novel building panel unit which is strong, light-weight and which employs inexpensive materials in its fabrication.

A further object of the present invention is to provide such a panel unit which is capable of rapid and simple assembly and fabrication.

Another object of the present invention is to provide such a panel which lends itself to being assembled by unskilled labor.

Another object of the present invention is to provide such a bearing wall which serves as an excellent thermal and moisture barrier.

Other objects, advantages and features of the present invention will become more apparent from the following description.

SUMMARY OF THE INVENTION

In accordance with the principles of this invention, the above objects are accomplished by providing a wall construction which comprises first and second panels of reinforced cementitious material, the panels being spaced apart and substantially parallel, at least one core member positioned between the first and second panels, and connecting means for joining the first and second panels into a unitary structural member, the core member having a substantial void therein also comprising barrier means.

The wall may be integrally formed of a plurality of such first and second panels placed side by side. The core member serves as a thermal and moisture barrier and may take on several different configurations to be described in more detail below.

Each of the said first and second panels comprises reticulated sheet reinforcing material in spaced relation to the core and embedded in cementitious material. The cementitious material is sprayed through and around the reticulated sheets positioned on both sides of the core, the components being fixedly held together to form a unitary wall structure, so that the structural characteristics of the unitary member are greater than the sum of the characteristics of the individual panels. Thus, a wall formed of a hollow core four inches thick, sandwiched between two 2 inch panels, takes on structural characteristics approximating those of an 8 inch reinforced concrete wall. The thus assembled panel units or walls may be utilized for forming any substantially planar barriers, such as floors, walls or the like.

As an advantage of the construction of the present invention, the necessity for affixing, after construction of the wall, moisture or thermal barriers or furring strips is eliminated. In addition, the necessity for affixing lathing and applying plaster or stucco is eliminated. The wall formed by the method of this invention does not necessarily require the finishing operations as in the prior art.

DETAILED DESCRIPTION

Figure 1:
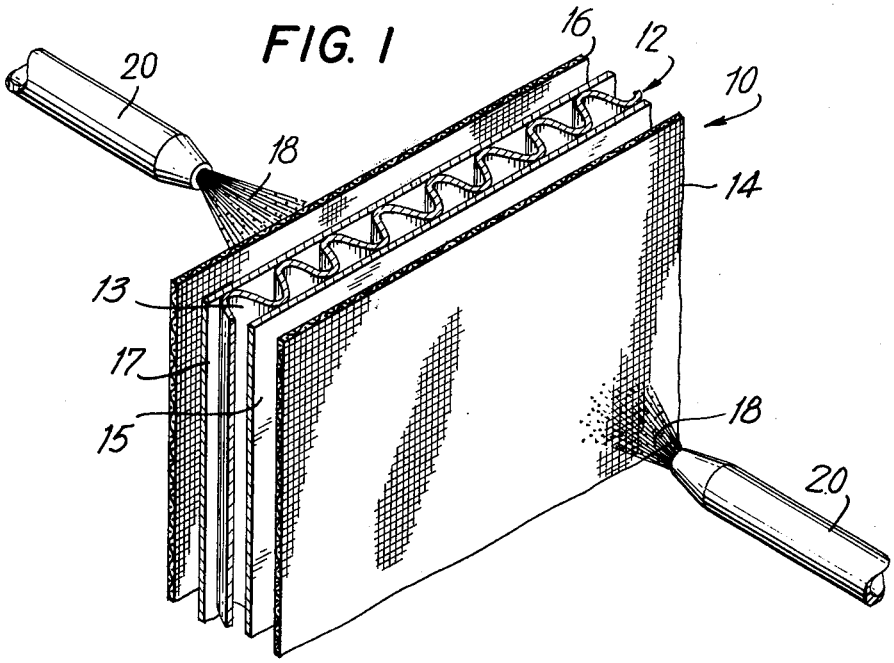
FIG. 1 is a schematic, exploded perspective view showing the manner in which the wall of this invention is formed, and showing also a first embodiment of the core member.
Figure 2:
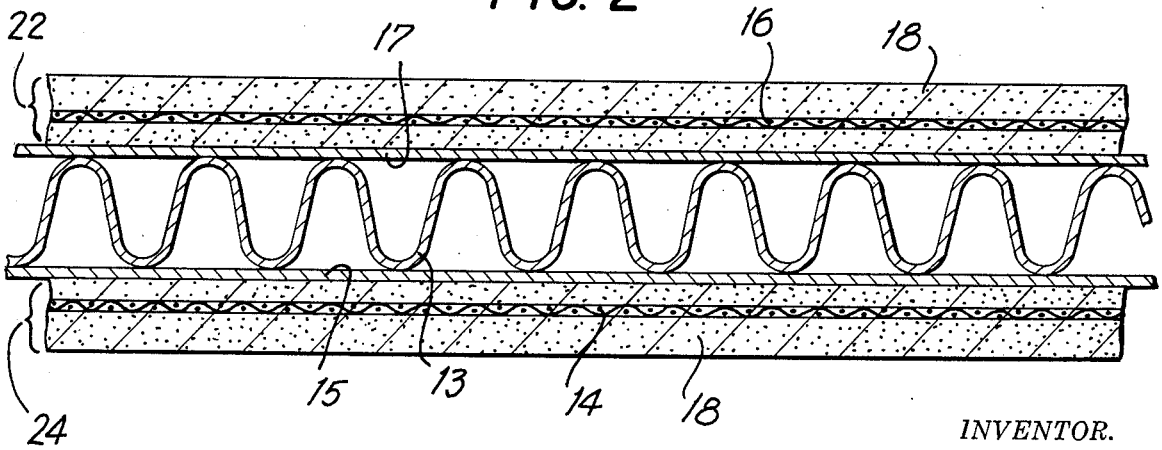
FIG. 2 is a typical cross-section through a wall formed in the manner illustrated in FIG. 1.

Referring now to the drawings, and in particular to FIGS. 1 and 2 thereof, there is shown a segment of the bearing wall 10 being formed. The bearing wall comprises a core member 12, first and second reticulated sheets of reinforcing material 14 and 16, respectively, and cementitious material 18 encompassing said sheets 14 and 16. The core member 12 is illustratively shown as a single member formed of corrugated paperboard having a substantial void therein comprising an undulating inner member 13 sandwiched between two outer members 15 and 17. The sheets 14 and 16 are spaced from the core by suitable means to be described hereinafter. The cementitious material 18 is then applied, as by spraying means 20—20, through and around the sheets 14 and 16. The core 12 serves as a backstop or barrier preventing the cementitious material sprayed at one side from passing through to the other. The cementitious material may also be applied by other methods, such as by troweling. The sheets 14 and 16 serve as the reinforcing means for the finished panels 22 and 24 so formed. The core member 12 serves not only as a physical barrier during the spraying process but also as a thermal and/or moisture barrier in the finished wall.

Although the core is shown as an enlarged corrugated paperboard, other advantageous configurations may be used, as hereinafter appear, and the core member 12 may be formed of any suitable lightweight, inexpensive material, and may advantageously be formed from folded sheets of conventional corrugated cardboard, suitably coated for the purpose intended.

Figure 4:
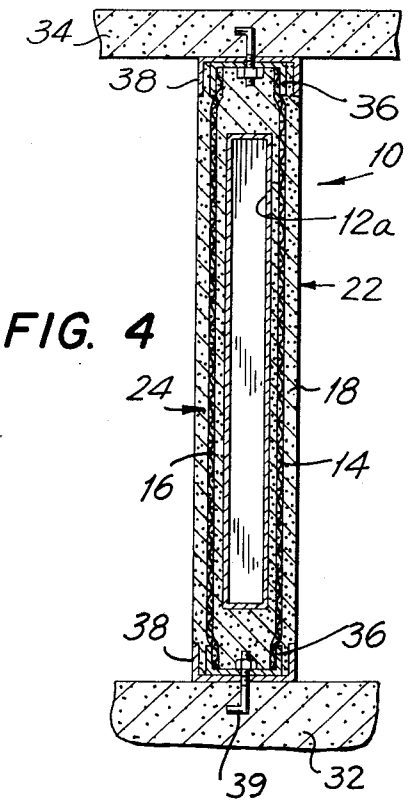
FIG. 4 is a sectional view taken along line 4—4 of FIG. 3.
Figure 3:
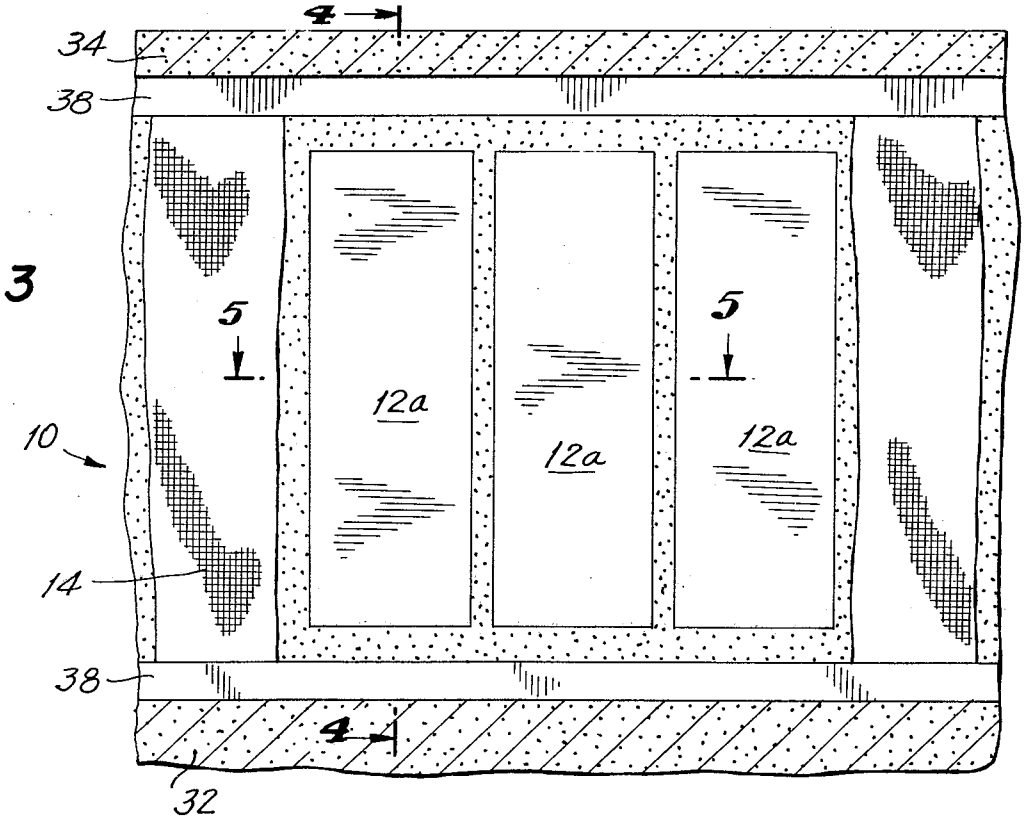
FIG. 3 is a front elevational view, partly in section, of one embodiment of this invention showing the manner in which a wall is formed with a core member that is not coterminus with the wall in any direction.
Figure 5:
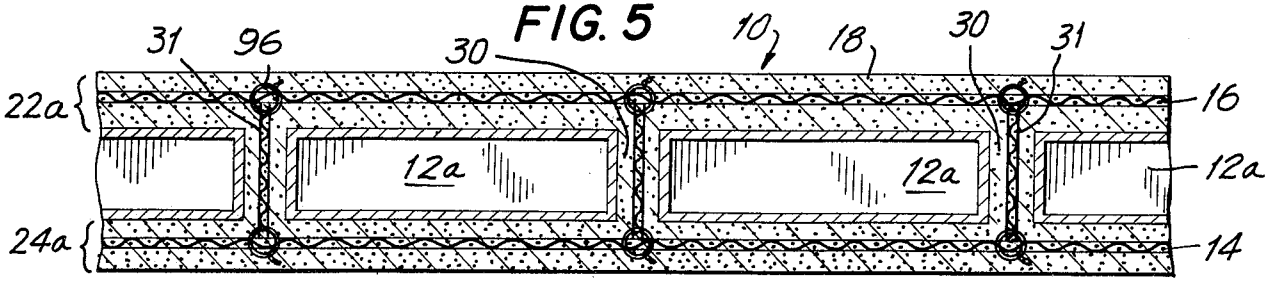
FIG. 5 is a cross-sectional view taken along line 5—5 of FIG. 3.

Referring now to FIGS. 3 through 5, there is shown one embodiment of my invention in which the wall 10 is formed of a plurality of adjacent cores 12a having a rectangular cross-section in outer configuration with the cores being in spaced side-by-side relationship. The reticulated sheets of reinforcing material 14 and 16 extend across the cores. Transverse reinforcement in the space 30 between the cores may be provided by an additional sheet of reinforcing material 31 extending through the space 30 and connected at its extremities to the sheets 14 and 16 as by wire ties 96, hog rings or the like. Alternatively, the sheet 31 may be formed integrally with the sheets 14 and 16. That is, a single sheet bent or formed into a U-shaped configuration may be utilized, with the transverse portion extending through the space 30 in a manner equivalent to that shown with regard to the sheet 31, and the two end portions extending in the same direction spaced from and parallel to the cores in a manner equivalent to that shown with regard to sheets 14 and 16. Thus, a web of reinforced cementitious material connecting the panels 22 and 24 is formed. As shown, the cores 12a are not coterminus in any direction with the reinforced cementitious panels 22 and 24.

In actual operation, and with reference to FIGS. 3 and 4, there is shown a preferred method for securing the wall components in position to the floor 32 and to the ceiling 34, either or both of which may comprise poured concrete slabs or similar surfaces. Guide or retainer means may be provided for the top and bottom longitudinal surfaces of the sheets 14 and 16. Same may preferably comprise a longitudinally extending U-shaped guide channel member 36, corresponding in width substantially to the distance between the sheets 14 and 16. The channels 36 may be centrally positioned in a second longitudinally extending U-shaped locating channel or screed 38 corresponding in width to the total thickness of the finished wall including the panels 22 and 24. As shown, the screed channel 38 and guide channel 36 may preferably be of a length equal to the length of the wall. In addition, each associated screed channel member 38 and guide channel member 36 may be preformed as an integral unit, as by welding or riveting and secured to the supporting surface 32 or 34 by any suitable means such as anchor bolts 39 spaced at suitable intervals.

A core unit, which comprises a plurality of core members 12*a* and reinforcing sheet members 14 and 16, may be prefabricated at the site or elsewhere. For example, where a core 12*a* is not coterminus with the wall panels, as shown in FIGS. 3–5, a first sheet 14 may be laid over a core or plurality of cores, positioned as desired, and then the sheet may be attached thereto as by staples or the like. Then, this partial assembly may be turned over and the second sheet 16 likewise positioned over and fastened to the core. The thus completed core unit 12*a*, 14, 16 may then be raised into position with the ends of the sheets 14 and 16 within the guide channel members 36. The said core unit may be held therein by suitable securing means such as a friction fit therebetween. Alternatively, saddle pins (not shown) extending through pre-drilled holes in the channel member 36 and through the extreme portions of the sheet material 14 and 16 may be used to locate and anchor the core unit.

In the event that the wall is raised before the fabrication of the ceiling 34, the upper surface of the top screed channel member 38 may serve as a horizontal supporting surface for forms for the ceiling. Following securement of the assembled core units 12*a*, 14, 16 to the floor and/or ceiling, in the manner as aforesaid, the cementitious coating 18 is then applied, as by the above-described spraying, toward the exterior surfaces of the cores, to a thickness or depth equal to the space between the core member 12*a* and the outer edge of the screed channel member 38 to form a unitary wall which can serve as a bearing wall. If desirable, in order to prevent cementitious material from dropping into the hollow interior of the core, where the core does not extend to the upper dimension of the wall, the core 12*a* may be provided with a top portion, as shown in FIG. 4, or a separate cover may be provided (not shown).

Figure 7:
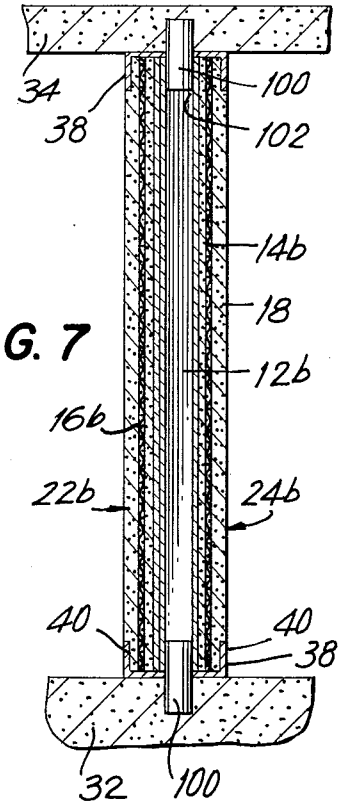
FIG. 7 is a sectional view taken along line 7—7 of FIG. 6.
Figure 6:
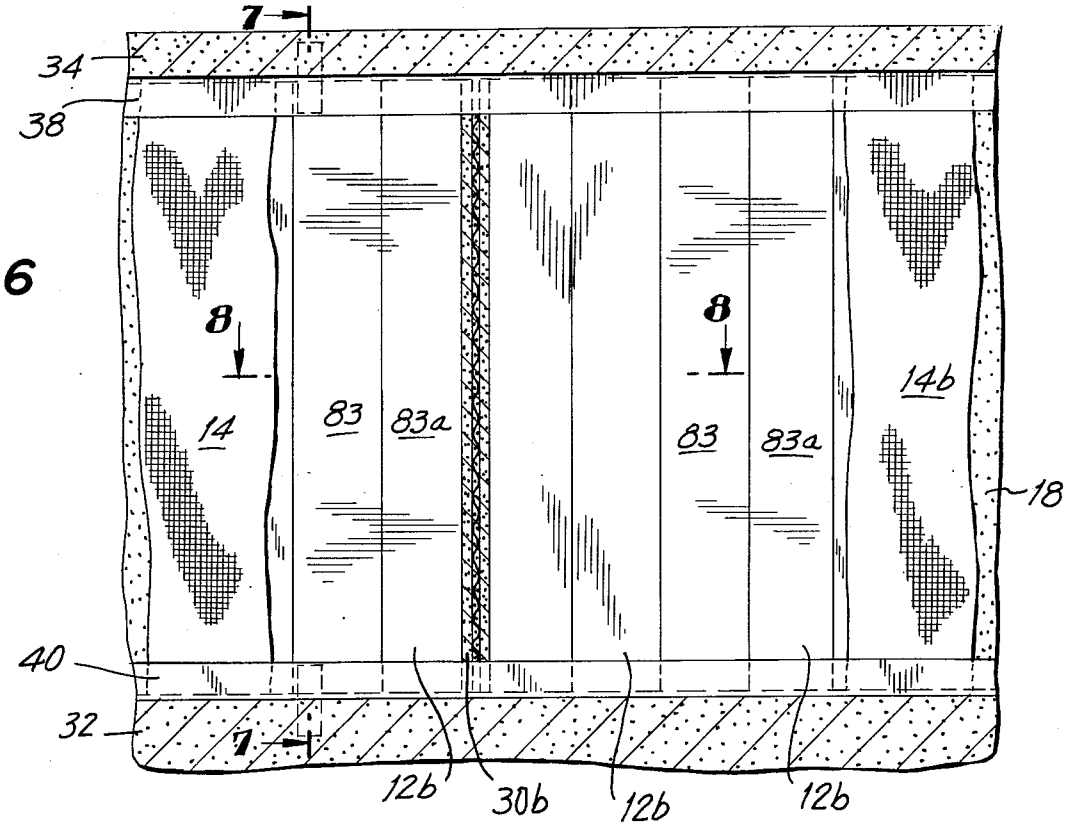
FIG. 6 is a view similar to FIG. 3 showing another embodiment of this invention wherein the core member is coterminus with the wall in the vertical direction.
Figure 8:
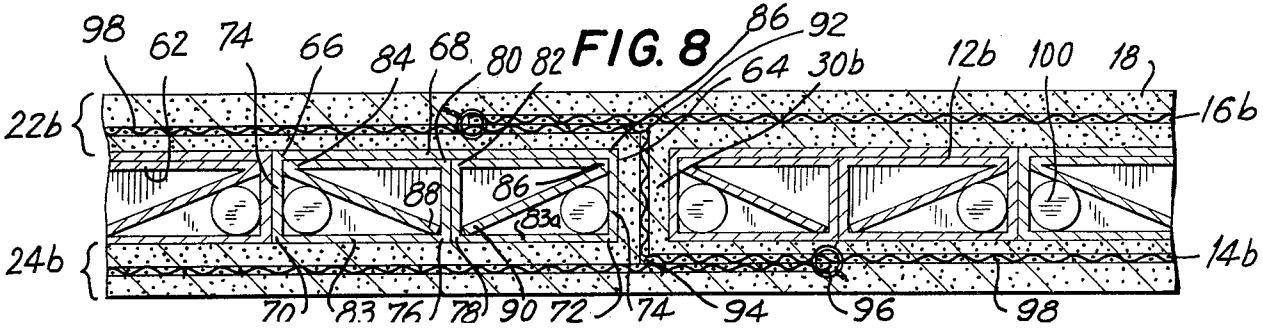
FIG. 8 is a cross-sectional view taken along line 8—8 of FIG. 6.

Referring now to FIGS. 6 through 8, there is illustrated another embodiment of my invention for forming a load bearing wall. In this embodiment, the core member 12*b* is formed of folded sheets of corrugated sheet material 62. The corrugated sheet material is folded along prescore lines 64 and 66 to form one outer side 68 and along prescore lines 70 and 72 to form the sides 74 of the core. The sheet material is then folded inwardly along prescore lines 76 and 78 and at 80 and 82 to form the other outer side 83 and 83*a* of the core. Next the sheet material is folded diagonally inwardly at prescore lines 84 and 86 whereby the distal ends 88 and 90 of the sheet material rest against the inner sides of prescore lines 76 and 78, respectively. As can be readily appreciated, such a core construction is relatively sturdy with substantial support therefor being formed.

Groups of cores 12*b* may be placed in side-by-side abutting relationship with a space 30*b* between groups of cores, the purpose of which will be described hereinafter. Alternatively, the cores 12*b* may be singularly placed in side-by-side spaced relation.

In order to obtain reinforcement for the cementitious material to be applied both to the opposite sides of the core members and in the space 30*b* therebetween, a plurality of sheets may be arranged in the manner as aforedescribed with regard to FIG. 5. Alternatively, reticulated sheets of reinforcing material 14*b* may be bent or folded into a substantially Z-shaped configuration with the transverse portion thereof positioned in the spaces 30*b* between cores or groups of cores, and the end or flange portions thereof extending in opposite directions in substantially parallel spaced relation with the outer surfaces of adjacent cores or groups of cores. More particularly, in practice, a sheet 14*b* may be initially positioned in a space 30*b*, substantially in the center thereof. The sheet 14*b* may then be bent or folded as at 92 and 94 to form flanges 98 extending in opposite directions along the length of a core or group of cores. The flanges of each adjacent sheet 14*b* will be in overlapping engagement and may be held in such position as by hog rings, wire ties 96, or the like.

Of course, the sheets 14*b* may be pre-formed into the Z-shaped configuration. Then, in practice, one pre-bent sheet will be fitted into position in the guide channel 36 and core members likewise positioned adjacent a respective flange 98 and held in spaced relation thereto in the manner hereinafter described. Then a second pre-bent sheet is positioned and so on.

The cementitious material 18 is then applied as by spraying or troweling through and around the sheets 14*b*, both in the spaces 30*b* and to the outer surfaces 68 and 83, 83*a* of the cores, to the desired thickness. It will thus be seen that the resulting wall will comprise two panels of reinforced cementitious material 22*b* and 24*b* in substantially parallel spaced relation, with a core 12*b* therebetween, and the said panels 22*b* and 24*b* being integrally structurally connected by a web of reinforced cementitious material extending in the spaces 30*b* between the cores.

Preferably, the space 30*b* and, therefore, the web of reinforced cementitious material formed therein, will be of a thickness approximately equal to the thickness of the wall panels 22*b* and 24*b* so as to obtain a substantially equal distribution of stress to each of the said wall panels, thus, in effect, producing a wall having structural characteristics approximately equal to the overall thickness of the combined wall 10.

As illustrated in FIG. 6, the cores 12*b* are coterminus with the panels 22*b* and 24*b* in the vertical direction only so that the aforedescribed web of cementitious material will, in such instance, extend only the vertical distance between panels. Alternatively, however, where, as in FIG. 3, the panels are not coterminus in either direction, reinforcing sheet material may be applied either in the manner illustrated in FIG. 5 or using a combination of the techniques shown in both FIGS. 5 and 8, so that the resulting web of cementitious material will extend about the entire periphery of the wall panels.

Referring now to FIG. 7, there is shown an alternative embodiment for locating and retaining the cores 12*b* in an upright position between the floor 32 and ceiling 34. More particularly, the floor and ceiling will have embedded therein locating steel dowels 100, projecting upwardly and downwardly respectively, which fit into the void 102 in the core to hold the core in place. The dowels 100 serve in lieu of the guide channel member 36. Optionally, the screed channel 38 may also be dispensed with. Where the screed 38 is utilized, conventional techniques are employed to finish the wall using the outer ends 40 of the screed 38 as a guide. However, where the screed is not utilized, an alternative planing technique may be employed for such wall finishing purposes, such as the planing apparatus described in another of my patent applications.

Figure 9:
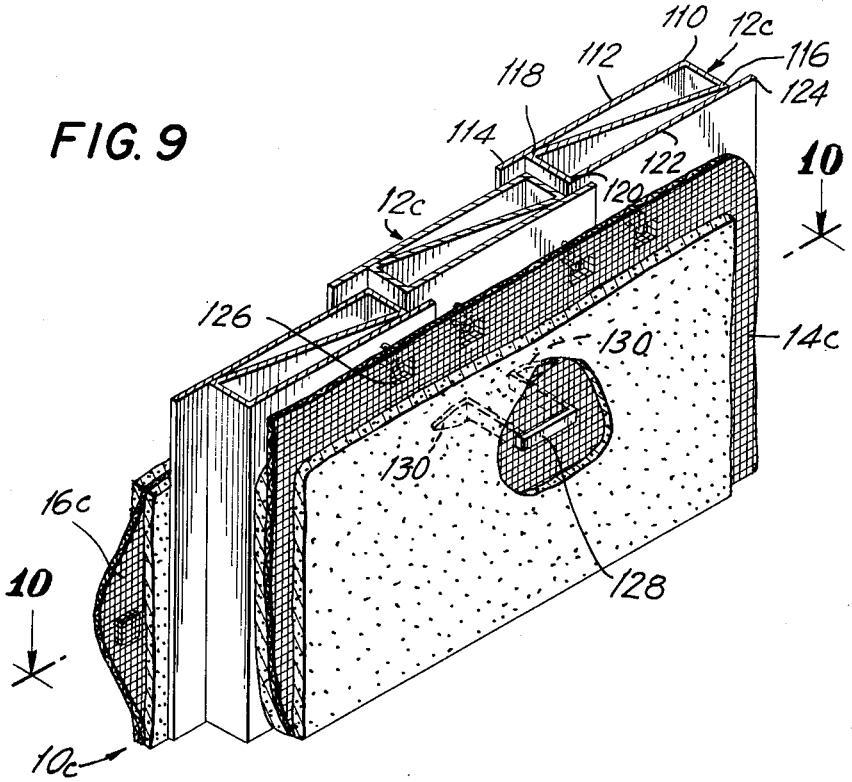
FIG. 9 is a partial perspective view of a section of a wall of this invention showing yet another embodiment of the core member and showing also one means for spacing the sheet material from the core member and one means for interconnecting the panels of reinforced cementitious material.
Figure 10:
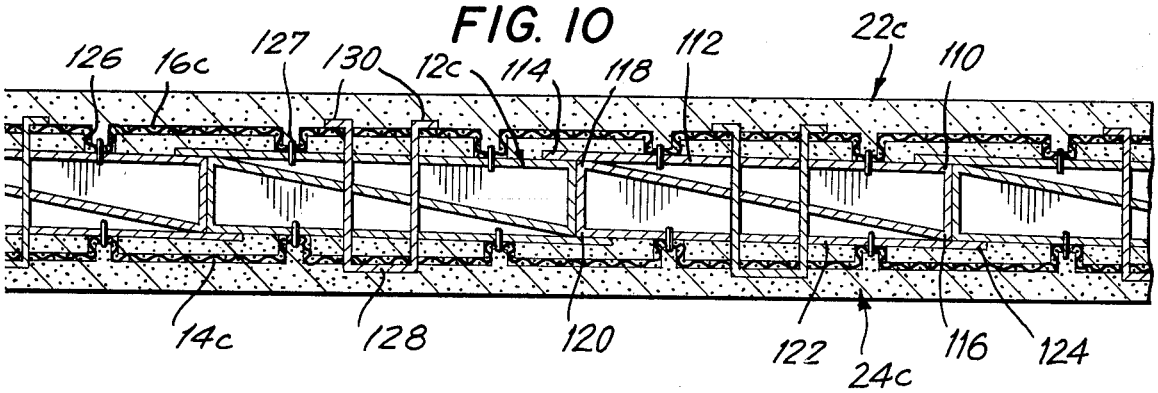
FIG. 10 is a cross-sectional view taken along line 10—10 of FIG. 9.

Referring now to FIGS. 9 and 10, there is shown yet another embodiment of the core member and also one means for spacing the sheet material from the core member. The core 12*c* may again comprise a corrugated paperboard construction but with the core folded into a double triangular shape as here described. The paperboard is folded downwardly along prescore line 110 to form one outer surface 112 of the core having a tab portion 114 which overlaps a segment of the adjacent core 12*c* on one side. The board is then folded diagonally upwardly along prescore line 116, to form the thickness of the core, then outwardly along prescore line 188, and then along prescore line 120 to form the opposite outer surface 122 of the core with a tab portion 124 provided therein to overlap a segment of the adjacent core on the other side. As illustrated, the cores are placed in a side-by-side abutting relationship.

The reticulated sheets of reinforcing material 14*c* and 16*c* are placed on opposite sides of the core and are spaced therefrom by spacer means 126 integrally formed with the sheets as protrusions or dimples at predetermined locations in the sheet. The sheets are connected to the cores at the protrusions 126, as by staples 127, ties or the like. The interconnection between panels 22*c* and 24*c* is accomplished as by spaced apart structural ties 128. Such ties comprise clips formed of galvanized steel having the shape of a staple and sharpened at both ends 130 thereof. Thus, the ties or clips 128 are able to pierce through one side of one of the sheets 14*c*, the core member 12*c* and the opposite side of the other sheet 16*c*, where it is folded over at the ends to constitute a structural member interconnecting the opposing panels 22*c* and 24*c* into a unitary structure possessing its own structural characteristics different from and greater than the combined structural characteristics of the individual panels. The clip 128, as the aforedescribed web of reinforced cementitious material, serves to distribute the load to both of the reinforced cementitious panels so joined. The cementitious material is then applied in the manner aforedescribed to form the wall 10*c*.

Figure 11:
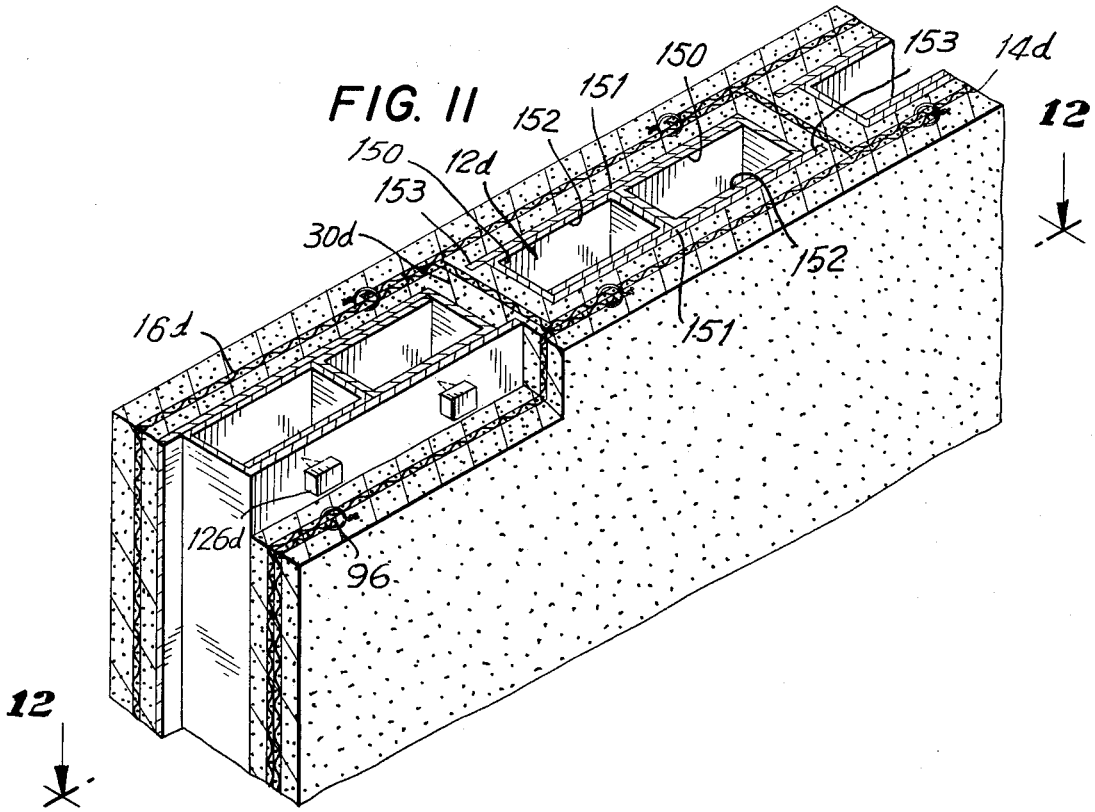
FIG. 11 is a view similar to FIG. 9 showing another embodiment of the core member and alternate embodiments of the means for spacing the sheet material from the core member and for interconnecting the panels of reinforced cementitious material.
Figure 12:
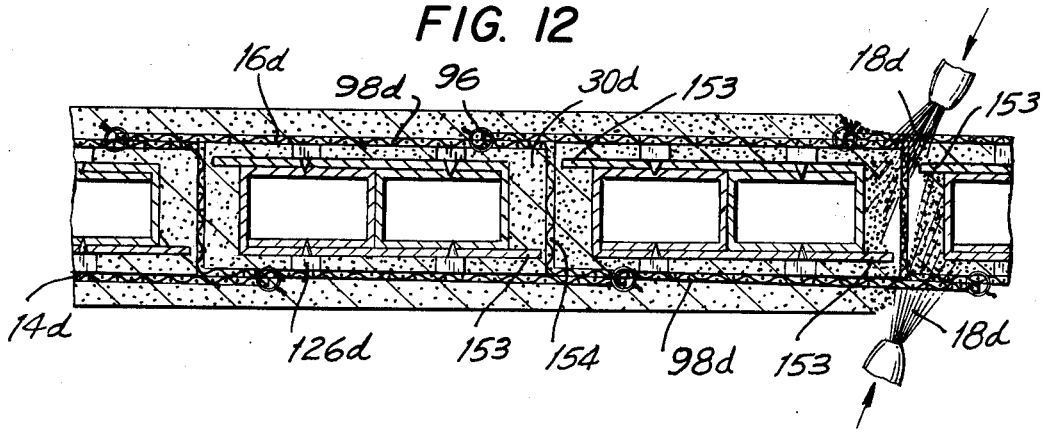
FIG. 12 is a cross-sectional view taken along line 12—12 of FIG. 11, showing the wall being formed.

Referring now to FIGS. 11 and 12, there is shown still another embodiment of my invention in which the core members 12*d* are in spaced apart side-by-side relationship with their tab portions extending at least partially across the space therebetween. More particularly, there is shown yet another manner in which a core member may be formed of folded paper, another means for spacing the reticulated sheets of reinforcing material from the core and an alternate method for laying up the core and sheet material so as to facilitate the spraying of cementitious material and to erect a web of reinforced cementitious material interconnecting the panels.

In the embodiment of FIGS. 11 and 12, the core 12*d* comprises two sheets of corrugated paperboard 150, each folded in the shape of a rectangle with opposite sides having a second wall 151 extending at least double its length so that when the two folded sheets are nested together, with their walls 151 oppositely extending, they comprise a core member 12*d*. As such, the core would be substantially the equivalent of the core 12*b* of FIGS. 6–8. Alternatively the wall 151 may extend beyond the wall 152 of its mating opposite to form a tab portion 153.

The cores 12*d* may thus be erected in the manner as aforesaid.

More particularly, as illustrated in FIGS. 11 and 12, the reticulated sheets of reinforcing material 14*d* are bent or folded into a substantially Z-shaped configuration, in the manner as aforesaid. The cores 12*d* are placed in spaced apart side-by-side relationship with their tab portions 153 extending less than half the distance of the space 30*d* between cores. The sheet 14*d* is positioned with its transverse portion 154 bisecting the space 30*d* and its flanges 98*d* extending in opposite directions in substantially parallel spaced relation to the line of cores 30*d*. The flanges of adjacent sheets 14*d* will be in overlapping engagement and held as by wire ties 96.

Spacer means 126*d*, separable from both the core member 12*d* and the sheets 14*d* are attached to the core member, as by tacking, stapling, cementing or the like. The spacer means 126*d* may comprise relatively small blocks of material such as plastic or wood, which can readily be fastened to the core member.

Where, as in FIGS. 5 and 8, there is a space between core members, the spraying of cementitious material is facilitated as by having a workman hold a board to the side of the wall opposite the spraying to prevent the sprayed material from passing between the space to beyond the wall.

Where, however, as in FIG. 12, tab portions such as 153 are provided, the skilled mechanic will not require the assistance of a workman with a board as aforesaid. By holding the nozzle 20*d* at an angle to the space 30*d* so as to direct the spray 18*d* against the tab portions 153 the mechanic will be able to gradually build up a web of material in the space. If necessary, he may allow a short setting time between successive layers of cementitious material.

It will be appreciated that various of the elements of any one embodiment herein disclosed may be substituted for like elements in any other embodiment. For example, either of the spacer means 126 or 126*d* may be utilized in either of the embodiments of FIGS. 1 and 2; 3 to 5; 6 to 8; 9 and 10; or 11 and 12. Likewise any of the cores herein described may be used interchangeably, as desired, and adapted for use with any suitable means for structurally connecting the opposing panels of reinforced cementitious material.

It is also apparent that the wall construction of this invention is adaptable to a multi-story construction, since each wall is independent of the wall of an upper or lower floor and can serve as a load-bearing wall.

The construction of my wall is not limited to on site erection, since the invention lends itself to pre-fabrication for erection at the site. A core member such as that shown in FIG. 1 may lend itself more to pre-fabrication off the site, and the wall member of my invention may be constructed in a continuous machine with wall sections being cut into predetermined sizes.

The core 12 may be of any material affording the required rigidity either by reason of its material construction or by reason of the shape into which it is formed. When moisture and thermal insulation are desirable, the core material should also possess these requisite attributes but these attributes are not necessary to accomplish the objects of the invention.

The core, however, does serve the following purposes:

a. To act as a support for the sheets of reinforcing material 14 and 16;
b. To act as supports, when desired, for window and door frame openings;
c. To act as a backstop or barrier to prevent the cementitious material from passing through to the opposite side when such material is applied;
d. When desired, to act as a vapor and thermal barrier in the finished wall construction.

The sheets of reinforcing material 14 and 16 may be of any material suitable for reinforcing the cmentitious material and also provided with through openings or apertures so as to facilitate the spraying of the cementitious material to the space between the inside surface of the sheet and the corresponding surface of the core member, and, further, its firm embedment in the concrete wall.

Since the sheets 14 and 16 serve, in the final analysis, as the reinforcement means in the finished concrete wall, it is contemplated that the sheets of reinforcing material have structural capability much in the same manner as steel reinforcing bars in conventional reinforced concrete construction, and the sheet may comprise any of the following or their equivalent:

a. Expanded sheet metal;
b. Perforated sheet metal;
c. Welded wire fabric;
d. A lattice of steel rods welded, wired or otherwise fastened together;
e. Separated strips of solid sheet material; and
f. Any of the foregoing provided with dimples or protrusions that may serve as the means for spacing the sheet from the core member.

From the foregoing, it will be appreciated that the wall comprises two panels of reinforced cementitious material 22 and 24 structurally tied together. In one instance, as when the Z construction is used (FIGS. 5, 8 and 12), the connection comprises a web of reinforced cementitious material. In the other instance, where the cores are in close juxtaposition, the clip 128 (FIGS. 9 and 10) serves as the structural tie.

The reinforced concrete web produced from the Z construction derives from the fact that the groups of the cores are in spaced apart, side-by-side relationship with the reinforcing sheet material passing in the space therebetween, in the manner described and illustrated, to permit the flow of cementitious material through the said space 30, thus forming a web of reinforced cementitious material interconnecting and integral with the opposing panels of reinforced cementitious material coterminus with the space provided.

The wall of my invention may be pre-assembled either wholly or in part, as described above, and may have window or door units secured thereto prior to assembly in situ, or provision may be made for cutting openings for these window and door units at the time of erection of the wall units. It is believed apparent that by the provision of such a structure, assembly of a housing unit or other building utilizing these panel members is made extremely feasible with a minimum of effort, the use of lightweight and inexpensive materials, and results in a structure of considerable strength.

It will thus be seen that the objects set forth above, among those made apparent from the preceding description, are efficiently attained and, since certain changes may be made in the above method and construction without departing from the scope of the invention, it is intended that all matter contained in the above description and shown in the accompanying drawings shall be interpreted as illustrative and not in a limiting sense.

What is claimed is:

1. In a wall structure having a plurality of core members arranged in an array along the line of the wall, a sheet of reticulated reinforcing material spaced outwardly from each of two opposite side faces of said array in an overlying relationship and affixed to said core members at spaced intervals, a layer of sprayed cementitious material embedding each of said reticulated sheets to extend from a side face of said array to an outer face of the wall structure, and rigid connecting members extending transversely of said array interconnecting both of said layers of cementitious material at spaced intervals, the improvement wherein each core member is an elongated, hollow enclosure extending verticaly from the bottom to the top of the wall, each said closure comprises a flat sheet of imperforate stiff material folded to form two, spaced-apart parallel side surfaces positionable in the plane of the wall line, two end surfaces spaced apart a distance substantially greater than said side surfaces to extend transversely thereof and a stiffening member extending transversely within the enclosure along its verticaly disposed length between said side surfaces, each enclosure having extensions of a side surface protruding a substantial distance beyond each of its two end surfaces, said connecting members comprise a plurality of metal shafts piercing said enclosures with each of the two ends of each shaft extending through a respective reticulated sheet, and adjacent enclosures are arranged with their respective surfaces in a plane parallel to a plane of the wall line with said extensions of each enclosure in an overlapping relation to a side surface of an adjacent enclosure in a manner to form a line of juxtaposed, vertically disposed enclosures having overlapping surfaces establishing an air filled core extending throughout the wall structure and separating the cementitious material of the wall into said two layers having no cementitious material interconnections.

2. The wall structure of claim 1 wherein each said enclosure side surface has a single extension protruding beyond a different end surface.

3. The wall structure of claim 2 wherein one of said enclosure side surfaces and its extension comprise one end portion of said flat sheet, the next portion of said folded flat sheet adjacent said one end portion comprises that one of said enclosure end surfaces as is opposite the extension of said one side surface, the next portion of said folded flat sheet adjacent said one end surface comprises said internal stiffening member, the next portion of said folded flat sheet adjacent said stiffening member comprises the other of said end surfaces and the next adjacent and other end portion of said folded flat sheet comprises the other of said side surfaces and its extension.

4. A wall structure comprising a plurality of elongated, hollow members arranged in a side-by-side array along the line of the wall with the lengthwise dimension of the members disposed vertically in the direction of the height dimension of the wall, each said hollow member comprising an imperforate, flat sheet of cellulostic material folded to form a pair of spaced-apart, parallel, side surfaces extending along the lengthwise dimension of the member parallel to the wall line, a pair of spaced-apart, parallel end surfaces extending along the lengthwise dimension of the member perpendicular to said side surfaces establishing a rectangular, air-filled enclosure in conjunction with the side surfaces and a stiffening member extending transversely within said enclosure along the lengthwise dimension of the member in contact with both said side surfaces, each said member having projections of a side surface extending beyond both said end surfaces in a contacting, overlapping relation to side surfaces of an adjacent member in a manner establishing said array as a line of juxtaposed, overlapping, mutually self-supporting enclosures forming a central air-filled core throughout the wall structure, a plurality of metal connector shafts each extending transversely through a hollow member at spaced intervals over a side face of said array of members and each having its end portions spaced outwardly of one of said member side surfaces, a sheet of reticulated metal material spaced outwardly of and overlying each of the two side faces of said array established by the respective side surfaces of the hollow members and in contact with the end portions of said connecting shafts protruding from the side faces of the array, and sprayed cementitious material covering both sides of each said reticulated sheet forming a layer extending from each side face of said array to each outer face of the wall with said reticulated sheets and adjacent connecting shaft portions embedded in the respective layers of cementitious material separated by the thickness of said array of members and unconnected by cementitious material.

5. The wall structure of claim 4 wherein said hollow members are formed from folded flat sheets of corrugated cardboard.

6. A wall structure comprising two parallel slabs of sprayed concrete arranged in a spaced-apart, vertical array on opposite sides of a vertically extending hollow core through which no cementitious material penetrates connecting said slabs, a layer of reticulated reinforcing material embedded within each said slab of concrete sprayed thereon and affixed to an underlying face of said core, said core comprising a plurality of elongated, hollow enclosures arranged in juxtaposition with their lengthwise dimensions vertical, each said enclosure formed from sheets of stiff, imperforate material folded to form a hollow section of rectangular cross section having a pair of opposing side faces to be positioned in the plane of the wall and perpendicular thereto a pair of verticaly extending end faces with a portion of said folded sheet extending diagonally between said side faces within said hollow section, an extension tab integral with a side face projecting outwardly beyond each hollow section to overlie a portion of the side face of each adjacent enclosure, and a plurality of rigid metal members extending transversely of said core between said layers of reinforcing material and slabs at spaced intervals.

7. The wall structure of claim 6 wherein each said enclosure is formed by folding a single, flat sheet of cellulosic material and the end faces of each adjacent enclosure abut.

8. The wall structure of claim 7 wherein one side portion of each said sheet forms one side face and extension tab of an enclosure, the portion of said sheet next adjacent said one side portion forms one end face of said hollow section, the portion of said sheet next adjacent that portion forming said one end face forms the said sheet portion extending diagonally between said side faces, the portion of said sheet next adjacent said sheet portion extending diagonally between said side faces forming the other of said end faces of said hollow section and the remaining portion of said sheet forming the other side face and extension tab of said enclosure.

* * * * *